United States Patent [19]

Nagy et al.

[11] 3,999,335

[45] Dec. 28, 1976

[54] ACCESS COVER AND CLEAT CONNECTION THEREFORE

[75] Inventors: Nicholas Nagy, Westport; Clinton F. Egerton, Stamford, both of Conn.

[73] Assignee: International Telephone and Telegraph Corporation, Nutley, N.J.

[22] Filed: Mar. 25, 1975

[21] Appl. No.: 561,758

[52] U.S. Cl. ..... 52/19; 52/477; 52/730; 49/33; 404/25

[51] Int. Cl.[2] ..... E04F 19/08; E06B 11/00

[58] Field of Search ..... 52/19, 20, 21, 127, 52/211, 475, 581, 656, 729, 730, 731, 753 K, 758 H, 477, 732; 404/4, 5, 7, 25; 49/33

[56] References Cited

UNITED STATES PATENTS

| | | | |
|---|---|---|---|
| 826,746 | 7/1906 | Priddle | 404/2 |
| 1,985,992 | 1/1935 | Hayman | 52/753 K |
| 2,837,153 | 6/1958 | Brown et al. | 52/758 H |
| 2,990,922 | 7/1961 | Rudisill | 52/731 |
| 3,067,845 | 12/1962 | Smith et al. | 52/730 |
| 3,879,912 | 4/1975 | Cox | 52/656 |

*Primary Examiner*—James L. Ridgill, Jr.
*Attorney, Agent, or Firm*—John T. O'Halloran; Peter C. Van Der Sluys

[57] ABSTRACT

An access cover frame for an underground station such as a pumping station is provided with a cleat connection for assembling a plurality of access covers to accommodate various size stations. The access cover frames are formed of members having a base and parallel sides which define an outwardly facing channel. Returned flanges are formed on said sides and cover a portion of the channel. A longitudinally extending cleat connecting member has grooves formed along the length thereof for receiving the returned flanges of juxtaposed frames thereby connecting said frames along the juxtaposed sides.

6 Claims, 3 Drawing Figures

ACCESS COVER AND CLEAT CONNECTION THEREFORE

BACKGROUND OF THE INVENTION

1. Field of the Invention

The present invention relates to underground stations and more particularly to access covers for said stations that may be connected to accommodate various size and shaped stations.

2. Description of the Prior Art

Underground stations such as sewage pumping stations are usually custom designed to meet the particular needs of an installation as they pertain to size and configuration. Access covers for such stations must also vary as to size and configuration. Thus, the access covers for large multi-pump stations were either custom designed or formed of several smaller standard size access covers each separately cast into the concrete top of the pumping station. Custom designed covers were expensive to manufacture while the individually cast standard covers were expensive to install because reinforced concrete was required between adjacent covers.

In order to provide standard access covers for the most commonly used installations, at least 8 different size covers were required. The need for such a large number of sizes substantially increased the inventory cost for the cover manufacturers and suppliers.

The installation of multiple access covers significantly increased the cost of the pumping station since the covers had to be either welded or bolted together or separately cast into the concrete top of the station.

SUMMARY OF THE INVENTION

The present invention contemplates access covers for underground stations that are adapted to be connected using a cleat connection for engaging the juxtaposed sides of the covers to be connected. The access covers may be connected together on site without the use of expensive welding equipment or time consuming bolted connections. The need for reinforced concrete between the adjacent covers is also eliminated.

The access covers are provided in three standard sizes which were uniquely selected so that the length of a smaller size equals the width of the next larger size so that the covers may be connected to accommodate most any size or shape pumping station. By using only three standard size access covers, the inventory costs are considerably reduced and the need for custom designed access covers is eliminated.

The access cover frames are provided with flanges that are received by longitudinal grooves formed in the cleat connecting member so that the cleat connecting member engages flanges on two juxtaposed frames that are to be connected. The frames are connected by merely placing two frames in juxtaposition and sliding the cleat connecting member in place to receive the flanges.

Through the use of the cleat connection, the cover frames may be quickly and inexpensively assembled on site thereby eliminating the need for costly field welding or bolting operations. The cleat connection is adapted to attach the frames in such a way that they form a rigid box beam configuration for spanning the access opening in the concrete top of the pumping station.

It is the primary objective of the present invention to provide standard size access covers that may be readily connected to accommodate various size pumping stations.

It is another objective of the present invention to provide access covers having frames that may be field connected without welding or bolting.

Another objective of the present invention is to provide a unique cleat connecting member for engaging the frames of adjacent access covers to provide a rigid beam structure for spanning an opening in the concrete top of a pumping station.

Above-mentioned and other features and objectives of the invention will become more apparent by reference to the following description taken in conjunction with the accompanying drawings wherein one embodiment of the invention is described.

DESCRIPTION OF THE PREFERRED EMBODIMENT

Figure 1:
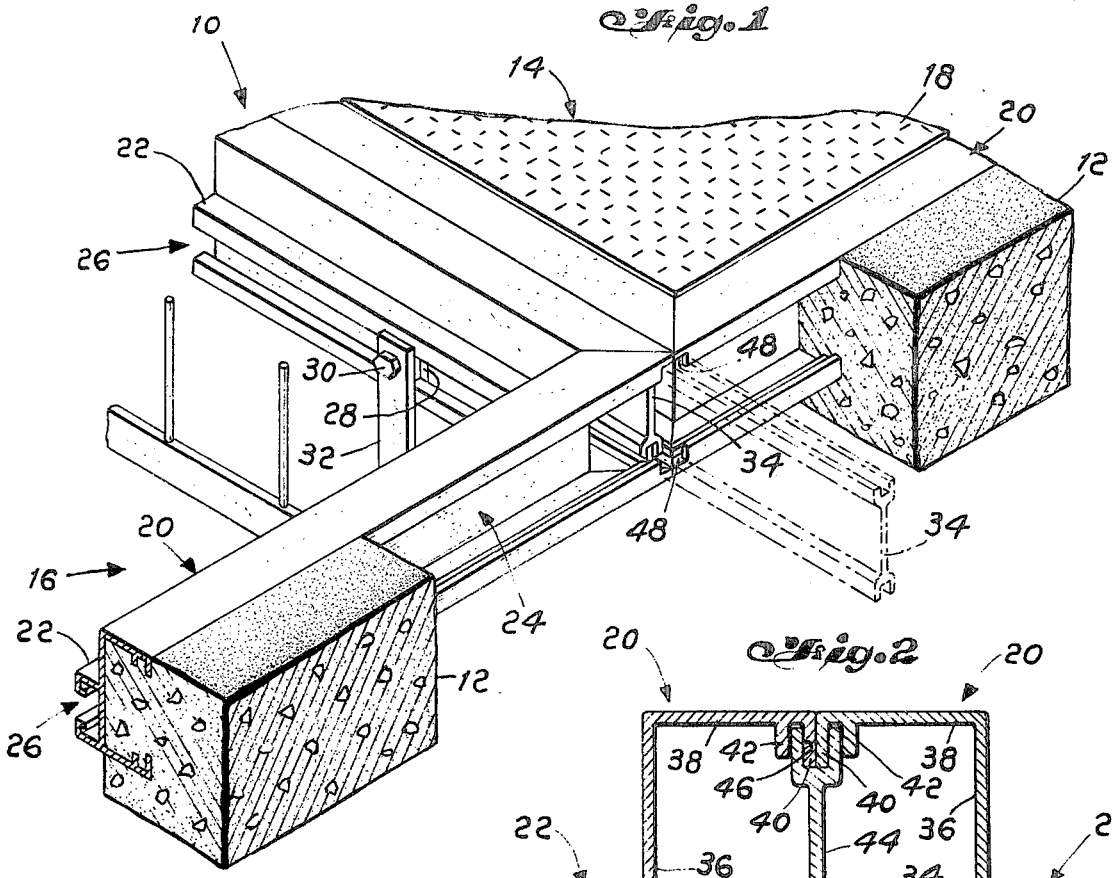
FIG. 1 is a perspective view of a portion of an access cover assembly shown partially in section.

Referring to FIG. 1, there is shown a portion of an access cover assembly 10 cast in a concrete top 12 of a pumping station. The cover assembly comprises two attached access covers 14 and 16. Access cover 14 has a cover plate 18 hingedly attached to a rectangularly shaped access cover frame 20. Access cover 16 also has a cover plate hingedly attached to a frame 20; however, since the cover is shown in the open position, the cover plate is not seen.

Access cover frames 20 comprise inwardly facing channel portions 22 and outwardly facing channel portions 24. Inwardly facing channel portions 22 are constructed in accordance with the teachings of Applicants' U.S. patent application Ser. No. 524,098, filed Nov. 15, 1974 and entitled "Access Cover With Moveable Attaching Devices For Underground Pumping Stations and Other Installations." The channel portions 22 define a peripheral slot 26 formed about the opening in the access cover frame 20, said slot being adapted to receive threaded attachment members 28 which are slideably disposed therein. A bolt 30 is used to connect an accessory such as a cable hanger 32 to the access cover frame 20 by engaging cable hanger 32 and attachment member 28.

The adjacent access covers 14 and 16 are connected by a cleat connecting member 34 which extends along substantially the entire length of the juxtaposed sides of the access covers.

Figure 2:
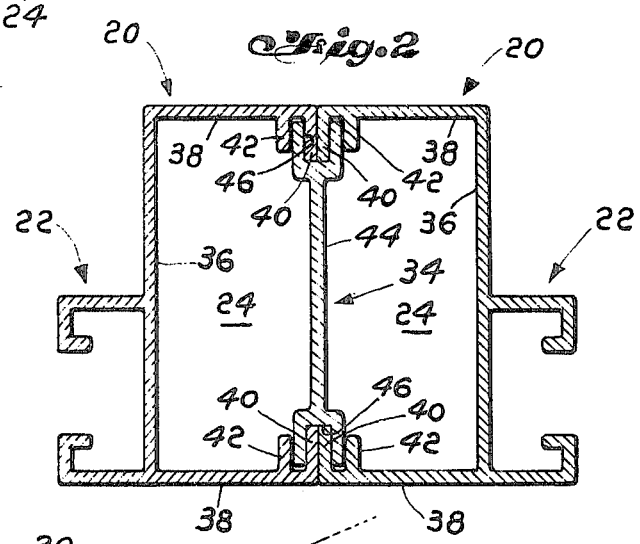
FIG. 2 is a vertical section showing portions of two connected frame members.

Referring to FIG. 2, there is shown the structural details of the access cover frames 20. The outwardly facing channel portions 24 of the frames 20 are formed of base portions 36 and parallel sides 38. Returned flanges 40 are formed on sides 38 and partially cover the channel portions 24. Additional flanges 42 are formed parallel to and spaced from flanges 40.

Cleat connecting member 34 is formed with a central body portion 44 and oppositely disposed grooves 46 formed on the edged thereof to receive the flanges 40. Cleat connecting member 34 has a length sufficient to extend substantially along the entire length of the juxtaposed frame sides so that the connected frame sides form a box beam configuration as shown clearly in FIG. 2.

It is to be understood that the previously described structure is preferred and that it could be modified in many ways while still practicing the novel concept of the present invention. The cleat connecting member could be described as having two extending flanges rather than a groove which are received in grooves formed between flanges 40 and 42. In a similar manner, the sides 38 could be made thicker with grooves formed therein into which flanges on the cleat connecting member extend for engaging the frames 20. It is even possible to eliminate the grooves and flanges on one side if the grooves and flanges are made deep enough on the opposite side.

Figure 3:
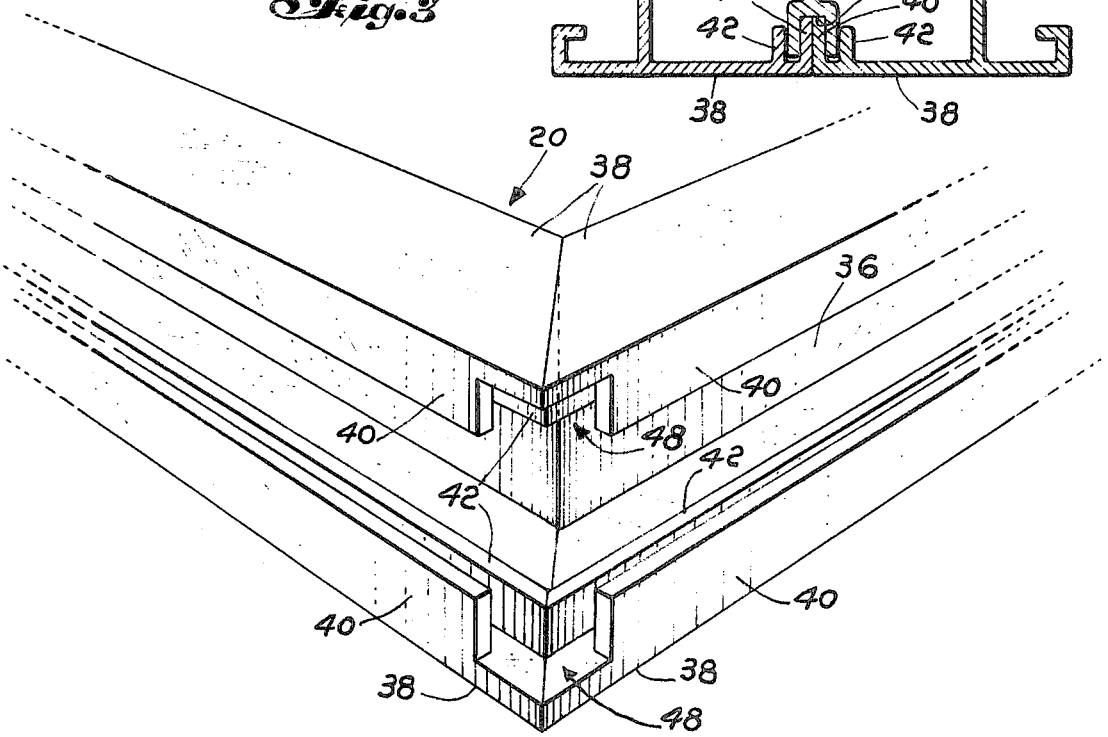
FIG. 3 is a perspective view showing the detailed structure of a corner portion of an access cover frame.

Referring to FIG. 3, there is shown the detailed structure of the corner of an access frame 20 wherein portions of flanges 40 are removed to provide openings 48 through which the cleat connecting members 34 may be slid as shown by dashed lines in FIG. 1.

Preferably, the cover frames 20 are extruded from aluminum which is thereafter anodized to provide a pleasing and durable finish. The aluminum is light weight, durable and less expensive than steel which were used heretofore. It is proposed that the access covers be provided in three standard sizes in which the length of one size equals the width of the next larger size such as 24 by 36 inches; 36 by 42 inches; and 42 by 60 inches. With these standard sizes, a customer may be able to tailor the access covers to fit any pumping station configuration or size by combining the various size covers.

Thus, it is apparent that the present invention eliminates the need for custom designed covers by providing an access cover frame that may be easily connected to other access cover frames during field installation to accommodate any size pumping station. The need for vast inventories of many sizes of covers is eliminated along with the cost of such an inventory. The cover frame is light weight, durable and has a pleasing finish. The access frames may be connected in the field without expensive welding equipment or time consuming bolted connections. The need for reinforced concrete portions between adjacent covers is also eliminated by the present invention.

What is claimed is:

1. An access cover frame structure of the type adapted to be selectively connected to similar cover frame structures along juxtaposed sides using longitudinally extending cleat connecting members having means for engaging portions of said frame structure along the juxtaposed sides, said frame structure comprising:

a plurality of elongated members connected at their ends to form a closed frame, said elongated members each having inner and outer surfaces;

a pair of outer sides attached to the outer surface of each of said members and extending outwardly therefrom to define an outwardly facing channel;

a pair of flanges attached to each pair of outer sides and extending towards each other to cover a portion of the channel on opposite sides thereof, said flanges being arranged to be in juxtaposition with corresponding flanges of another frame structure to be connected, said juxtaposed flanges adapted to be engaged by the cleat connecting member, the ends of said flanges being recessed so as not to engage the ends of flanges of the connected members whereby access openings are provided through which the cleat connecting member may pass when frame structures are being connected together;

a pair of inner sides attached to the inner surface of each of said members and extending inwardly to define an inwardly facing channel;

a pair of flanges attached to each pair of inner sides and extending towards each other to cover a portion of the inwardly facing channel on opposite sides of said channel;

attaching members slidably disposed in said inwardly facing channel and adapted to engage the flange members; and fastening means for engaging said attaching members and fixing said attaching members at any desired location along the inwardly facing channel, said fastening means being adapted to mount accessories at any preferred location about the opening in the access cover frame structure, whereby a plurality of frame structures may easily be connected in the field to provide an overall access cover frame to match the size of a particular underground installation and accessories may be mounted in the most desirable positions.

2. An access cover frame structure as described in claim 1, additionally comprising a second flange formed on each of said outer sides, said second flange being spaced inwardly from the first flange, thereby defining a groove through which the cleat connecting member may pass when engaging portions of said frame structure.

3. A frame structure as described in claim 1, additionally comprising a cover member hingedly attached to said frame at a selected position by said attaching means.

4. An access cover frame assembly, comprising:

first and second frame structures, each frame structure comprising a plurality of members connected to form a closed frame, said members each having an outwardly facing channel formed therein, said channel extending about the periphery of the closed frame, a pair of flanges attached to each of said members and extending towards each other to cover a portion of the channel on opposite sides thereof, an inwardly facing channel, a pair of flanges attached to each of said members and extending towards each other to cover a portion of the inwardly facing channel on opposite sides thereof, the flanges covering portions of the outwardly facing channel being recessed at the ends thereof to provide channel access openings at the connections between members, a selected member of each of said first and second frame structures being positioned so that the flanges covering portions of the outwardly facing channels of the selected members are disposed in juxtaposition;

a cleat connecting member comprising a longitudinal central portion and two bifurcated longitudinal edge portions formed on opposite sides of the central portion defining longitudinally extending oppositely facing grooves for receiving and engaging the juxtaposed flanges of the members whereby the frame structures are attached along the juxtaposed members;

attaching member slidably disposed in said inwardly facing channels and adapted to engage the flanges that partially cover said channel; and fastening means for engaging said attaching members and fixing said attaching members at any desired location along the inwardly facing channel, said fastening means being adapted to mount accessories at any preferred location about the opening in the access cover frame structures and the first and second frame structures may be selected from a limited number of standard sizes so as to provide an access cover frame assembly having the proper size required for the underground station.

5. A frame assembly as described in claim 4, additionally comprising cover plates hingedly attached to said first and second frame structures at a selected position by said attaching means.

6. An access cover frame structure of the type adapted to be selectively connected to similar cover frame structures along juxtaposed sides using longitudinally extending cleat connecting members having means for engaging portions of said frame structures along the juxtaposed sides, said cover frame structures also being adapted to be cast in a concrete top of an underground station, said frame structure comprising:

a plurality of elongated members connected at their ends to form a closed frame, said members each having a base and outwardly extending parallel sides that define an outwardly facing channel about the periphery of the frame;

a returned flange formed on each of said sides and covering a portion of the channel, said flanges being arranged to be selectively placed in juxtaposition with corresponding flanges of similar structures and engaged by a cleat connecting member or to be cast in a concrete top of an underground station, said concrete flowing into said outwardly facing channel and the flanges functioning to secure the member in the concrete;

a pair of inwardly extending parallel sides attached to the inner surface of the base and defining an inwardly facing channel;

a return flange formed on each of said inwardly extending parallel sides, extending towards each other to cover a portion of the inwardly facing channel;

attaching members slidably disposed in said inwardly facing channel and adapted to engage the flange members; and fastening means for engaging said attaching members and fixing said attaching members at any desired location along the inwardly facing channel, said fastening means being adapted to mount accessories at any preferred location about the opening in the access cover frame structure, whereby a plurality of frame structures may easily be connected in the field to provide an overall access cover frame to match the size of a particular underground installation and said cover frame may be conveniently cast in a concrete top of an underground station and accessories mounted in the most desirable positions.

* * * * *